United States Patent [19]

Ishihara

[11] Patent Number: 5,051,593

[45] Date of Patent: Sep. 24, 1991

[54] ELECTROSTATIC MULTIPOLE LENS FOR CHARGED-PARTICLE BEAM

[75] Inventor: Morio Ishihara, Tokyo, Japan

[73] Assignee: Jeol Ltd., Tokyo, Japan

[21] Appl. No.: 616,626

[22] Filed: Nov. 21, 1990

[30] Foreign Application Priority Data

Nov. 22, 1989 [JP] Japan ..... 1-303920

[51] Int. Cl.[5] ..... H01J 49/42

[52] U.S. Cl. ..... 250/396 R; 250/396 ML; 250/292

[58] Field of Search ..... 250/396 R, 396 ML, 292, 250/492.2

[56] References Cited

U.S. PATENT DOCUMENTS 3,725,700 4/1973 Turner ..... 250/292

*Primary Examiner*—Jack I. Berman

*Assistant Examiner*—Kiet T. Nguyen

*Attorney, Agent, or Firm*—Webb, Burden, Ziesenheim & Webb

[57] ABSTRACT

An electrostatic multipole lens consisting of flat electrodes, a pair of rod-like electrodes, and means for applying potentials to these electrodes. Each of the flat electrodes takes the form of a flat plate. The flat electrodes are disposed along an equipotential plane in an electrostatic n-pole field in or near planes given by $y=\pm(\tan(\pi/n))x$, the planes intersecting each other at the Z axis. The flat electrodes are cut out in the vicinity of the Z axis. The rod-like electrodes have surfaces which approximate in shape to a second equipotential plane in the n-pole field. The rod-like electrodes are located on the X axis in a region which contains the Z axis and is located between the planes. The potentials applied to these two kinds of electrodes correspond to the equipotential planes associated with the electrodes. Since the lens essentially consists only of the flat electrodes and the rod-like electrodes, the structure is simple. The dimension of the lens taken along the Y axis can be shortened.

8 Claims, 4 Drawing Sheets

ELECTROSTATIC MULTIPOLE LENS FOR CHARGED-PARTICLE BEAM

BACKGROUND OF THE INVENTION

The present invention relates to an electrostatic multipole lens used in an instrument utilizing a charged-particle beam such as a mass spectrometer.

Electrostatic multipole lenses such as electrostatic quadrupole lens, sextupole lens, and octupole lens are known as means for focusing beam of charged particles or for correcting aberrations in charged-particle beams. FIG. 1 shows an example of an electrode arrangement in an electrostatic octupole lens. In this geometry, eight cylindrical electrodes are circumscribed about a circle of radius r and equally spaced 45° from each other. Voltages of +V and −V are alternately applied to the electrodes.

In this geometry, the electrodes are equally spaced from each other circumferentially on the same circle. Where it is necessary to secure a wider path of charged particles in the direction of the X axis as indicated by the broken lines, the radius r of the circle is selected according to the width of the path taken along the X axis. Space is very inefficiently utilized along the Y axis. This makes it difficult to miniaturize the lens.

SUMMARY OF THE INVENTION

It is an object of the invention to provide an electrostatic multipole lens whose dimension taken along the Y axis can be reduced if a wide path of charged particles is secured along the X axis.

It is another object of the invention to provide an electrostatic multipole lens which has less electrodes than required heretofore but is capable of producing the same electrostatic multipole field as the electrostatic multipole field produced by the prior art instrument.

It is assumed that a beam of charged particles travels along the Z axis of an X-Y-Z rectangular coordinate system. An electrostatic multipole lens which acts on the beam of charged particles and is built in accordance with the present invention produces an electrostatic n-pole field in a lens region that contains the X axis and is located between planes which are given by $y=\pm(\tan(\pi/n))x$, respectively, where y=distance along the Y axis, x=distance along the X axis and n=the number of poles in the n-pole field and which meet at the Z axis. This novel multipole lens comprises: flat electrodes each of which takes the form of a flat plate and which are arranged along an equipotential plane in an electrostatic n-pole field in or near said planes given by $y=\pm(\tan(\pi/n))x$, the electrodes being cut out in the vicinity of the Z axis; rod-like electrodes having surfaces approximating in shape to a second equipotential surface in the electrostatic n-pole field to be produced in said lens region, the rod-like electrodes being located on the X axis spaced from the Z axis and means for applying those electrical potentials to the flat electrodes and the rod-like electrodes which correspond to said equipotential planes and surfaces associated with the n-pole field.

DETAILED DESCRIPTION OF THE PREFERRED EMBODIMENTS

Figure 2:
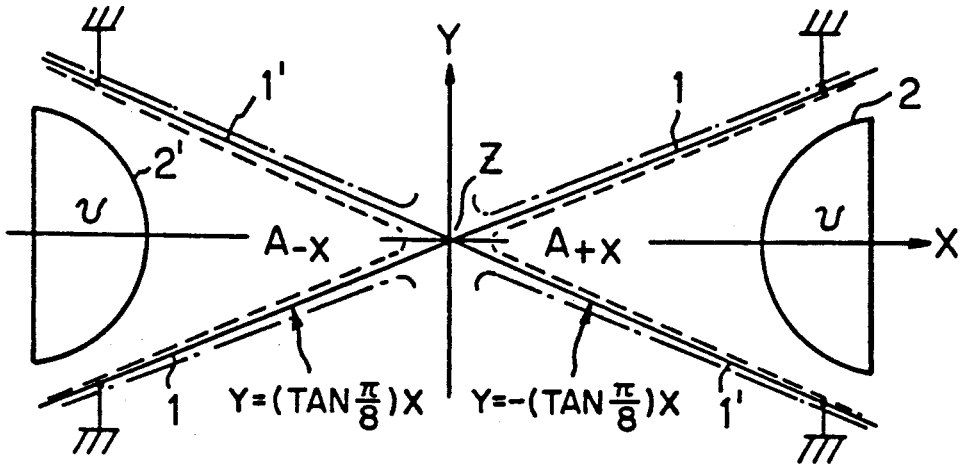
FIG. 2 is a diagram of an electrostatic octupole lens field illustrating the inventive concept.

The theory underlying the inventive concept is now described. It is assumed that a beam of charged particles travels along the Z axis of an X-Y-Z rectangular coordinate system. The path of the charged particles is extended along the X axis. We now discuss the case in which an electrostatic octupole field is set up over the whole extended path. Referring to FIG. 2, in accordance with the invention, grounded electrodes 1 and 1' each taking the form of a flat plate are disposed along two planes which intersect each other at the Z axis and are given by $y=\pm(\tan(\pi/8))x$, respectively. Rod-like electrodes 2 and 2' for producing the electrostatic octupole field are disposed in regions $A_{+x}$ and $A_{-x'}$ respectively, which are located between the grounded electrodes 1 and 1' and contain the X axis. The rod-like electrodes 2 and 2' extend parallel to the Z axis.

In the electrostatic octupole field, an arbitrary position on the X-Y plane can be represented in terms of polar coordinates (r, θ). The potential at this position is given by $$V(r, \theta)=V_0 r^4 \cos 4\theta \quad (1)$$

where $V_0$ is a coefficient related to the strength of the field.

The surfaces of the rod-like electrodes 2 and 2' which face the Z axis are formed by curved surfaces approximating to the equipotential plane where the potential given by equation (1) is equal to $v$, i.e., approximating to the planes connecting the points (r, θ) satisfying the relation $$v=V_0 r^4 \cos 4\theta \quad (2)$$

The potential $v$ is applied to the electrodes 2 and 2'.

It can be seen from equation (1) that in the electrostatic octupole field, the potential is zero on straight lines given by $\theta=\pm\pi/8$. These straight lines correspond to the planes given by $y=\pm(\tan(\pi/8))x$ in X-Y coordinates.

We now discuss the electric field produced in the regions $A_{+x}$ and $A_{-x}$ surrounded by the electrodes 2, 2' and by the grounded flat electrodes 1 and 1'. Around these regions, the potential is set to 0 along the planes $y=\pm(\tan(\pi/8))x$ by the flat electrodes 1 and 1', and equation (1) is fulfilled. Equation (2) is met because of the shape of the surfaces of the electrodes 2 and 2' and by the potential $v$. If the vicinity of the regions satisfy condition (1) of the electrostatic octupole field in this way, an octupole field satisfying equation (1) is generated in the regions $A_{+x}$ and $A_{-x}$ because of the nature of the electric field.

It is not always necessary that the electric fields 1 and 1' be disposed along the planes given by $y=\pm(\tan(\pi/8))x$ on which the potential is zero, because an octupole field satisfying equation (1) is produced inside the regions as long as in the vicinity of the regions condition (1) of the electrostatic octupole field is satisfied. As an example, as indicated by the broken lines or dot-and-dash lines in FIG. 2, the electrodes 1 and 1' are arranged along an equipotential plane of an appropriate potential close to zero. This potential is applied to the electrodes 1 and 1'. Also in this case, an octupole field satisfying equation (1) can be produced in the regions $A_{+x}$ and $A_{-x}$ surrounded by the electric fields 1, 1', and the rod-like electrodes 2, 2'.

On principle, the electrodes 1 and 1' give rise to curved planes extending along the equipotential planes rather than flat planes. If the potential is close to zero, the curved planes can be approximated by flat planes. If the diameter of the rod-like electrodes 2 and 2' is selected appropriately according to the distance from the Z axis, then the electrodes 2 and 2' can be approximated by cylindrical electrodes.

The theory underlying the inventive concept has been described. Since an octupole lens can be formed only by a pair of rod-like electrodes, 2, 2' on the X axis and a pair of electrodes 1 and 1', the structure is simple. Also, the dimension of the lens taken along the Y axis can be reduced.

Figure 3:
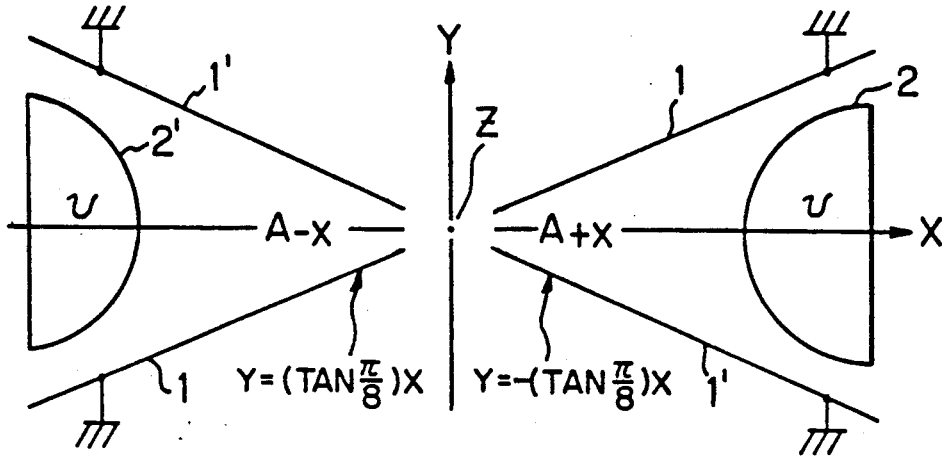
FIG. 3 is a diagram of an electrostatic lens for producing an octupole lens field according to the invention, the lens being capable of being put into practical use.

In the geometry shown in FIG. 2, however, the electrodes 1 and 1' exist even on the Z axis. That is, a beam of charged particles cannot pass along the Z axis and, therefore, this lens cannot be used as it is. FIG. 3 shows a practical example of the invention. In this example, the electrodes 1 and 1' are cut out around the Z axis.

The field produced around the Z axis slightly differs from the correct octupole field because of the absence of the electrodes which determine the potential. Generally, however, a field approximating the octupole field can be produced in the regions $A_{+x}$ and $A_{-x}$ containing the vicinity of the Z axis. Furthermore, since the strength of the electric field is weakest around the Z axis, the field is disturbed only a little. Therefore, the passing beam of charged particles is affected only a little. The effect of the disturbance is practically negligibly small.

Figure 4:
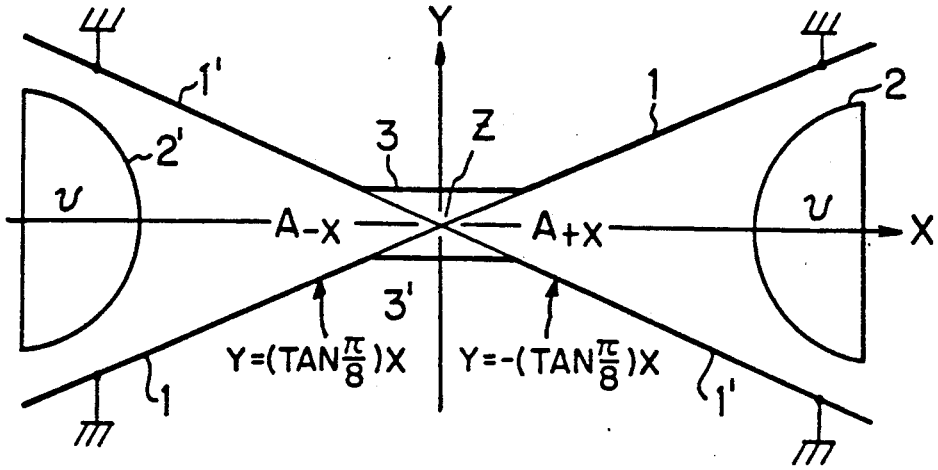
FIG. 4 is a diagram of an improvement on the lens shown in FIG. 3.

Referring next to FIG. 4, there is shown another example of the invention. This example is similar to the example shown in FIG. 3 except that a pair of grounded electrodes 3 and 3' are added. These electrodes 3 and 3' are located on opposite sides of the Z axis and extend parallel to both Z and X axes. The shielding effect of the grounded electrodes 3 and 3' prevents the electric field from leaking outward along the Y axis, which in turn prevents the field from being disturbed around the Z axis.

In the lenses shown in FIGS. 2-4, the curved surfaces of the electrodes 2 and 2' approximate in shape to the equipotential plane of potential $v$. Therefore, these two electrodes are arranged symmetrically with respect to the Z axis, and the same potential $v$ is applied to them. Also, the curved surface of one electrode can approximate an equipotential plane of potential $v'$ different from the potential $v$. In this case, the two rod-like electrodes are placed on the equipotential planes of the potentials, respectively. The potentials $v$ and $v'$ are applied to the rod-like electrodes, respectively.

In the lenses shown in FIGS. 2-4, an electrostatic octupole field is given as an example. Thus, the flat grounded electrodes 1 and 1' are arranged along the planes given by $y=\pm(\tan(\pi/8))x$. In the case of a more general electrostatic n-pole field, the grounded electrodes are arranged along the planes given by $y=\pm(\tan(\pi/n))x$. The curved surfaces of the electrodes 2 and 2' approximate in shape to equipotential planes in the electrostatic n-pole field. The potential of the equipotential planes is applied to the electrodes.

Figure 1:
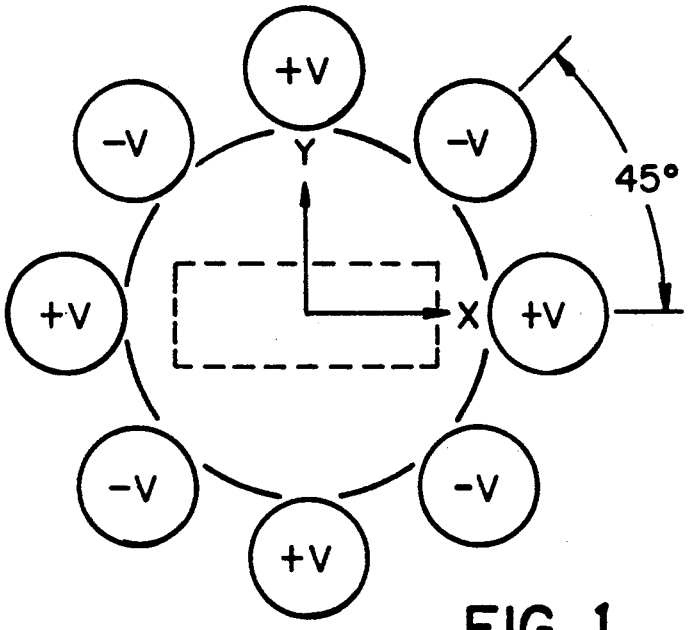
FIG. 1 PRIOR ART
FIG. 1 is a diagram of the prior art electrostatic octupole lens.
Figure 5:
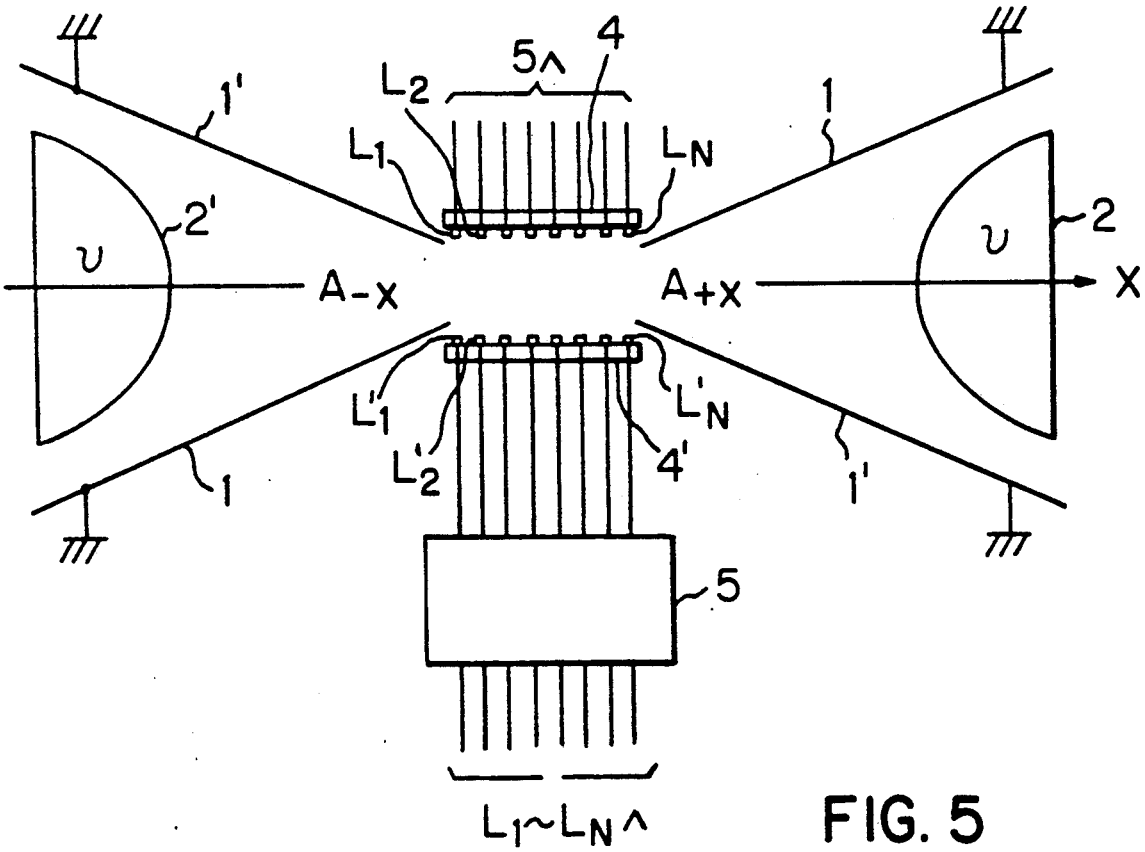
FIG. 5 is a cross-sectional view of another electrostatic lens for producing an octupole lens field according to the invention.

FIG. 5 is a cross-sectional view of a further electrostatic octupole lens according to the invention. It is to be noted that like components are denoted by like reference numerals in various figures. In FIG. 5, a pair of insulating base plates 4 and 4' extend parallel to the X axis and are disposed on opposite sides of the Z axis. Correcting electrodes $L_l$-$L_N$ and $L_{l'}$-$L_{N'}$ are installed on the surfaces of the base plates 4 and 4', respectively, which face the Z axis. The correcting electrodes are linear electrodes which extend parallel to the Z axis and are appropriately spaced from each other. These correcting electrodes are fabricated, for example, by printed circuit board fabrication techniques. Voltages which have been previously determined according to the correcting electrodes are supplied to them from a power supply 5.

The example shown in FIG. 5 is similar to the example shown in FIG. 3 except that the correcting electrodes are added. An electrostatic octupole field is produced in the regions $A_{+x}$ and $A_{-x}$ surrounded by the rod-like electrodes 2, 2' and the flat grounded electrodes 1, 1' As already described, the field differs slightly from the correct octupole field in the vicinity of the Z axis in which the flat grounded electrodes have been removed. The correcting electrodes are provided to correct the disturbance in the correct octupole field. A correcting electric field having a distribution and a strength which have been already found by calculations or experiments is developed. Data about the voltages to be applied to the correcting electrodes is stored in the power supply 5 to produce such a correcting electric field. Adequate voltages are applied to the correcting electrodes according to the data.

The disturbance of the electrostatic octupole field caused by the absence of the flat grounded electrodes 1 and 1' around the Z axis is corrected by correcting electric field produced by the correcting electrodes. Consequently, a correct electrostatic octupole field can be generated over the whole region, i.e., $A_{+x}$ plus $A_{-x'}$ which is surrounded by the electrodes 2 and 2', the flat grounded electrodes 1, 1', and the correcting electrodes and which contains the vicinity of the Z axis. If the correcting electrodes on either side are arranged in a line on a base plate, then it is desired that the correcting electrodes be sufficiently large in number.

Figure 6:
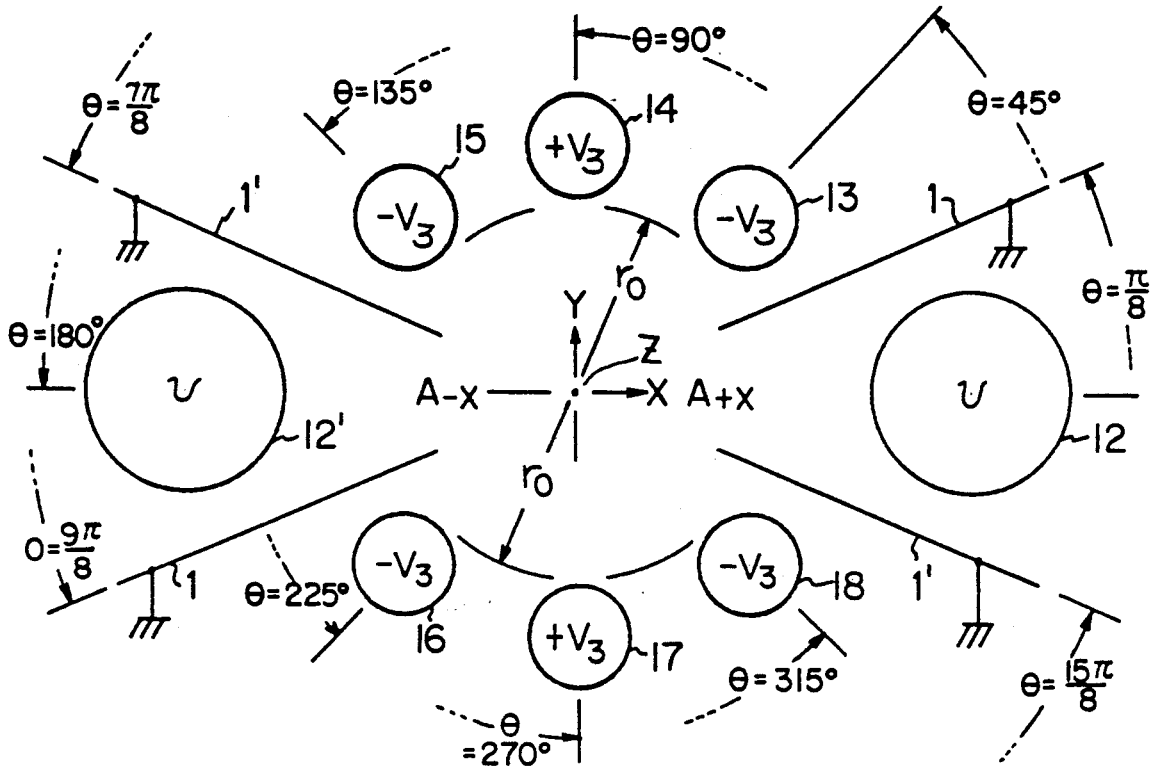
FIGS. 6–9 are diagrams of other electrostatic lens-producing multipole fields according to the invention.

FIG. 6 shows yet another example of the electrostatic octupole lens in which the number of correcting electrodes is reduced to a minimum. In this example, cylindrical electrodes 12 and 12' having a large diameter are used to produce a field approximating a correct electrostatic octupole field. Cylindrical electrodes having small electrodes 13-18 are employed as correcting electrodes.

The correcting electrodes 13-18 are circumscribed about a cylindrical plane which has a radius $r_0$ and whose center is located at the Z axis. The electrodes 13-18 are equally spaced $2\pi/8$ from each other. That is, their angular positions $\theta$ are 45°, 90°, 135°, 225°, 270°, 315°, respectively. Potentials of $\pm V_3$ ($|v|>|V_3|$) are applied alternately to the electrodes shown in FIG. 6.

Also in this geometry, the disturbance in the field near the Z axis is corrected by the correcting electric field produced by the correcting electrodes. Therefore, a correct electrostatic octupole field can be set up in the whole region which consists of the regions $A_{+x}$ and $A_{-x}$ and is surrounded by the electrodes 12, 12', and the flat grounded electrodes 1 and 1'.

Figure 7:
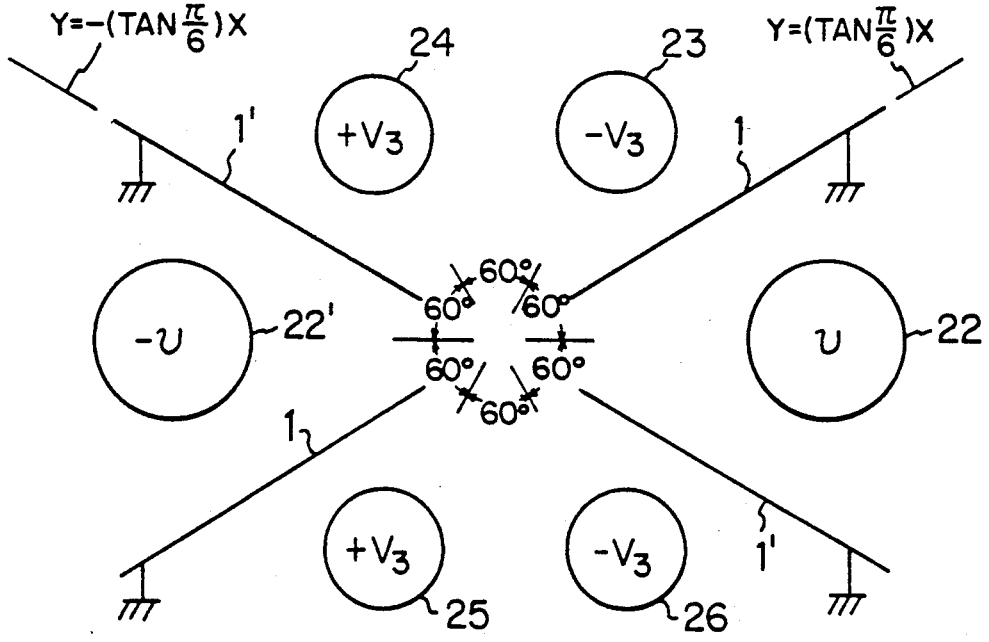

Referring to FIG. 7, there is shown an electrostatic sextupole lens according to the invention. This lens comprises electrodes 22, 22' having a large diameter, correcting electrodes 23, 24, 25, 26 having a small diameter, and flat grounded electrodes 1, 1'.

In the electrostatic sextupole field, the equipotential plane of zero potential is given by $\theta = m\pi/6$, where m=1, 3, 5, 7, 9, 11. The flat electrodes 1 and 1' are arranged along the planes given by $y = \pm(\tan(\pi/6))x$. The correcting electrodes 23–26 are circumscribed about a cylindrical plane which has a radius of $r_0$ and the center of which is located at the Z axis. The electrodes 23–26 are regularly spaced $2\ \pi/6$ from each other. That is, their angular positions $\theta$ are 60°, 120°, 240°, 300°, respectively. Two sets of correcting electrodes as shown in FIG. 5 can be used instead of the small correcting electrodes 23–26.

Figure 8:
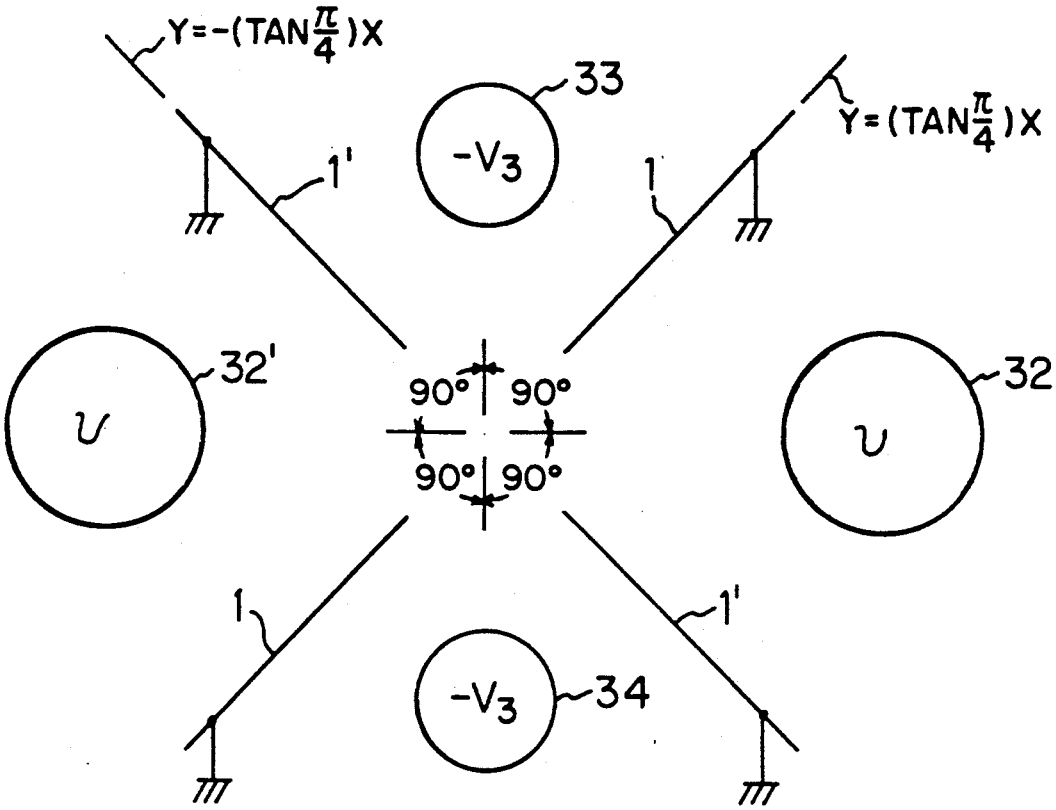

Referring next to FIG. 8, there is shown an electrostatic quadrupole lens according to the invention. This lens comprises electrodes 32, 32' having a large diameter, correcting electrodes 33, 34 having a small diameter, and grounded electrodes 1, 1' in the form of flat plates.

In the quadrupole field, the equipotential plane of zero potential is given by $\theta = m\pi/4$, where m=1, 3, 5, 7. The flat electrodes 1 and 1' are arranged along the planes given by $y = \pm(\tan(\pi/4))x$. The correcting electrodes 33 and 34 are circumscribed about a cylindrical plane which has a radius of $r_0$ and the center of which lies at the Z axis. The correcting electrodes are spaced $2\ \pi/4$ from each other. Their angular positions $\theta$ are 90° and 270°.

Figure 9:
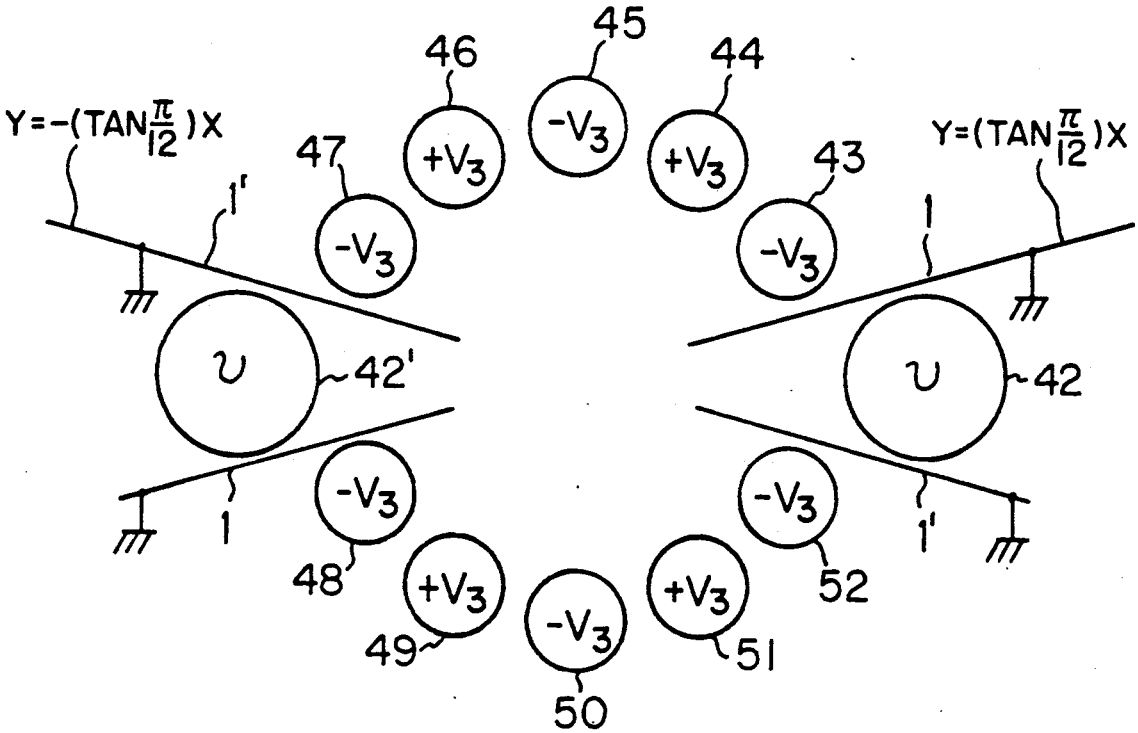

Referring to FIG. 9, there is shown an electrostatic lens which comprises electrodes 42, 42' of a large diameter, correcting electrodes 43–52 of a small diameter, and grounded electrodes 1, 1' each taking the form of a flat plate. The large electrodes 42, 42' and small electrodes 43–52 are spaced 30° from each other about the Z axis.

In the electrostatic dodecapole field, the equipotential plane of zero potential is given by $\theta = m\pi/12$, where m=1, 3, 5, 7, 9, 11, 13, 15, 17, 19, 21, 23. The flat grounded electrodes 1 and 1' are disposed along the planes given by $y = \pm(\tan(\pi/12))x$. The correcting electrodes 43–52 are circumscribed about a cylindrical plane which has a radius $r_0$ and the center of which is located at the Z axis. Their angular positions $\theta$ are 30°, 60°, 90°, 120°, 150°, 210°, 240°, 270°, 300°, 330°.

As described in detail thus far, in accordance with the invention, an electrostatic multipole lens can be realized which is small in size, simple in structure, and can have a reduced dimension along the Y axis if the lens offers a wide path of charged particles along the X axis.

It is to be noted that the invention is not limited to the above examples and that various changes and modifications may be made. For instance, the invention can be applied to lenses having more poles. The flat grounded electrodes are not always required to be symmetrically arranged.

Having thus described my invention with the detail and particularity required by the Patent Laws, what is claimed and desired to be protected by Letters Patent is set forth in the following claims.

What is claimed is:

1. An electrostatic multipole lens for acting on a beam of charged particles traveling along the Z axis of an X-Y-Z rectangular coordinate system, the lens producing an electrostatic n-pole field in a lens region which contains the Z axis and said field located between planes given by $y = \pm(\tan(\pi/n))x$, where y distance along the Y axis, x=distance from X axis and n=the number of poles in the n pole field, said planes intersecting each other at the Z axis, said electrostatic multipole lens comprising:

flat electrodes each of which takes the form of a flat plate and which are arranged along an equipotential plane of said electrostatic n-pole field in or near said planes given by $y = \pm(\tan(\pi/n))x$, the electrodes being cut out in the vicinity of the Z axis;

a pair of rod-like electrodes approximating in shape to a second equipotential surface in the electrostatic n-pole field to be produced in said lens region, the rod-like electrodes being located on the X axis spaced from said Z axis; and means for applying those electrical potentials to the flat electrodes and the rod-like electrodes which correspond to said equipotential planes and surfaces associated with the n-pole field.

2. The electrostatic multipole lens of claim 1, wherein a plurality of correcting electrodes extending parallel to the Z axis are disposed in two regions outside of the lens region along the Y axis which are located between the planes given by $y = \pm(\tan(\pi/n))x$ and wherein correcting potentials are applied to the correcting electrodes to reduce disturbances in the electric field in the vicinity of the Z axis.

3. The electrostatic multipole lens of claim 2, wherein said correcting electrodes are linear electrodes extending parallel to the Z axis and disposed on a pair of planes which are symmetrical with respect to the Z axis and parallel to the X axis.

4. The electrostatic multipole lens of claim 2, wherein said correcting electrodes comprise a plurality of electrodes angularly spaced $2\ \pi/n$ radians about the Z axis from each other and equally spaced from the Z axis so as to be circumscribed about a cylindrical plane whose center is located at the Z axis.

5. The electrostatic multipole lens of claim 1, wherein said rod-like electrodes are cylindrical electrodes.

6. The electrostatic multipole lens of claim 5, wherein a plurality of correcting electrodes extending parallel to the Z axis are disposed in two regions which are located between the planes given by $y = \pm(\tan(\pi/n))x$ outside the lens region along the Y axis and wherein correcting potentials are applied to the correcting electrodes to reduce disturbances in the electric field in the vicinity of the Z axis.

7. The electrostatic multipole lens of claim 6, wherein said correcting electrodes are linear electrodes extending parallel to the Z axis and disposed on a pair of planes which are symmetrical with respect to the Z axis and parallel to the X axis.

8. The electrostatic multipole lens of claim 6, wherein said correcting electrodes comprise a plurality of electrodes angularly spaced $2\ \pi/n$ radians about the Z axis from each other and equally spaced from the Z axis so as to be circumscribed about a cylindrical plane whose center is located at the Z axis.

* * * * *

UNITED STATES PATENT AND TRADEMARK OFFICE

CERTIFICATE OF CORRECTION

PATENT NO. : 5,051,593

DATED : September 24, 1991

INVENTOR(S) : Morio Ishihara

It is certified that error appears in the above-identified patent and that said Letters Patent is hereby corrected as shown below:

Title page, after Assignee: "Jeol Ltd." should read --JEOL Ltd.--.

Column 2 Line 25 "$A_{-x'}$" (prime) should read --$A_{-x}$,-- (comma).

Column 4 Line 26 after "1'" insert --.--.

Column 4 Line 63 "v" should read -- $\upsilon$ --.

Claim 1 Line 7 Column 6 "y distance" should read --y = distance--.

Signed and Sealed this

Sixth Day of April, 1993

*Attest:*

*Attesting Officer*

STEPHEN G. KUNIN

*Acting Commissioner of Patents and Trademarks*